US005724686A

United States Patent [19]

Neal

[11] Patent Number: 5,724,686

[45] Date of Patent: Mar. 10, 1998

[54] CUSHION OR MATTRESS BORDER SUPPORT

[75] Inventor: Charles H. Neal, Henrico County, Va.

[73] Assignee: Eastern Sleep Products, Inc., Richmond, Va.

[21] Appl. No.: 805,734

[22] Filed: Feb. 25, 1997

[51] Int. Cl.[6] ..... A47C 27/05; A47C 23/04

[52] U.S. Cl. ..... 5/717; 5/655.7

[58] Field of Search ..... 5/716–721, 740, 5/739, 655.7, 655.9

[56] References Cited

U.S. PATENT DOCUMENTS

| | | | |
|---|---|---|---|
| 3,210,781 | 10/1965 | Pollock | 5/718 |
| 3,262,135 | 7/1966 | Fasanella . | |
| 3,618,146 | 11/1971 | Ferdinand | 5/718 |
| 3,732,586 | 5/1973 | Frey . | |
| 3,822,426 | 7/1974 | Mistarz | 5/717 |
| 3,869,739 | 3/1975 | Klein . | |
| 4,429,427 | 2/1984 | Sklar . | |
| 5,040,255 | 8/1991 | Barber, Jr. . | |
| 5,537,699 | 7/1996 | Bonaddio et al. . | |

*Primary Examiner*—Alexander Grosz

*Attorney, Agent, or Firm*—J. Michael Martinez de Andino; McGuire, Woods, Battle & Boothe, L.L.P.

[57] ABSTRACT

A border support for a mattress or the like being comprised of a coil spring unit that has at least one row of coil springs, a first and second pair of spaced apart parallel foam strips positioned along at least a portion of an outer side of an outermost row of the coil springs, and a support band positioned about the outermost wall of the foam strip. The foam strips each have at least two longitudinal grooves formed on the inside wall of the foam strips with portions of the outer side of the outermost coil springs extending inwardly into the grooves. The border support being designed to eliminate the need for a border helical wire or rod and provide for a strong support for and stability to the mattress or the like.

9 Claims, 4 Drawing Sheets

CUSHION OR MATTRESS BORDER SUPPORT

II. TECHNICAL FILED

In general, the present invention relates to the field of cushion or mattress structures and, more precisely, to an improved cushion or mattress border support.

III. BACKGROUND OF THE INVENTION

Mattresses and cushions have included the positioning of a spring unit having several springs within the body of the mattress or cushion. Several mattresses and cushions have also used material, such as foam, to form the exterior wall of the mattress or the cushion, such that the convolutions of the spring coils on the outside row of the coil spring unit are inserted within slits that are formed on the inside wall of the foam material. Indeed, U.S. Pat. No. 3,822,426 discloses the use of a foam border stabilizer for mattress inner spring units that uses the above-mentioned slits to provide a stabilizing effect to the spring unit. The 426 Patent foam border stabilizer requires, however, the use of a top panel that is integral to and connected with the side foam section that has the slits formed on its inside wall. Further, the 426 Patent foam border stabilizer requires the use of preformed weldings that are formed at the peripheral edge between the top panel and the side panel. These weldings allow the side panel to be bent at a right angle and to be folded down over the outside row of the coil spring unit, thus allowing the convolutions of the spring coils on the outside row of the coil spring unit to be inserted within the slits.

The 426 Patent foam border stabilizers, however, disclose the use of foam material for the construction of the preformed weldings and the slits. Such foam material adds weight and manufacturing costs to the mattresses and cushions.

Additionally, several mattresses and cushions, as disclosed in U.S. Pat. No. 3,618,146 and U.S. Pat. No. 3,822,426, require the use helicalled or clipped border rods that connect the top and bottom outer edges of the top and bottom coils of the spring coils that form the outside row of the coil spring unit. These border rods are disclosed to form an outer edge perimeter support or frame for the coil spring units. These border rods add weight to mattresses and cushions, as well as additional manufacturing costs. The 146 Patent also discloses the use of wire coils being inserted into slits that are made into the foam perimeter pieces. The slits disclosed in the 146 Patent and the 426 Patent are not v-shaped grooves that are formed on the inside wall of the foam perimeter pieces.

In order to overcome the above-mentioned defects in the previously mentioned mattresses and cushions, there is a need for an improved cushion or mattress border support that eliminates the need for the use of helicalled or clipped border rods, and the need of preformed weldings and slits. The elimination of the border rods, and the preformed weldings and slits reduces the weight of the mattress or cushion, as well as the manufacturing costs. There is also a need for an improved cushion or mattress border support that eliminates the need for helicalled or clipped border rods and preformed weldings and slits, while still providing strong support for and stability to the mattress or cushion. Additionally, there is a need for an improved cushion or mattress border support that eliminates the need for helicalled or clipped border rods and preformed weldings and slits, and which consists of four sections that surround the coil spring unit and which have v-shaped rows formed on the inside wall of the sections for receiving the convolutions of the outer rows of the coil spring unit.

The improved cushion or mattress border support of the present invention meeting these requirements is described in more detail below.

IV. SUMMARY OF THE INVENTION

In accordance with the present invention, the disadvantages of the prior mattresses and cushions has been overcome. The improved cushion or mattress border support of the present invention allows a manufacturer of mattresses and cushions to reduce the weight and manufacturing costs of a mattress or cushion while providing for strong support to the coil spring unit and an extended cushioned and supported sleeping or sitting surface to the perimeter of the product for the use of the product.

According to the present invention, the improved cushion or mattress border support consists of four sections each having v-shaped rows formed on the inside wall of the sections for receiving the convolutions of the outer rows of the coil spring unit of the mattress or cushion. The sections are placed against the outer rows of the coil spring unit and are held in place through the use of a light-weight fabric band that surrounds the coil spring unit. Additionally, the improved cushion or mattress border support of the present invention is designed to provide strong support for the coil spring unit, while also providing firm sides to the mattress or cushion.

Accordingly, it is the primary object of the present invention to provide an improved cushion or mattress border support that eliminates the need for the use of helicalled or clipped border rods for holding the coil spring unit together. It is an additional object of this invention to provide an improved cushion or mattress border support that has v-shaped rows for receiving and holding in place the convolutions of the outer row of the coil spring unit.

Other objects and advantages of this invention will become apparent from the following description wherein is set forth, by way of illustration and example, certain embodiments of this invention.

V. BRIEF DESCRIPTION OF THE DRAWINGS

VI. DETAILED DESCRIPTION OF THE PREFERRED EMBODIMENTS

Figure 1:
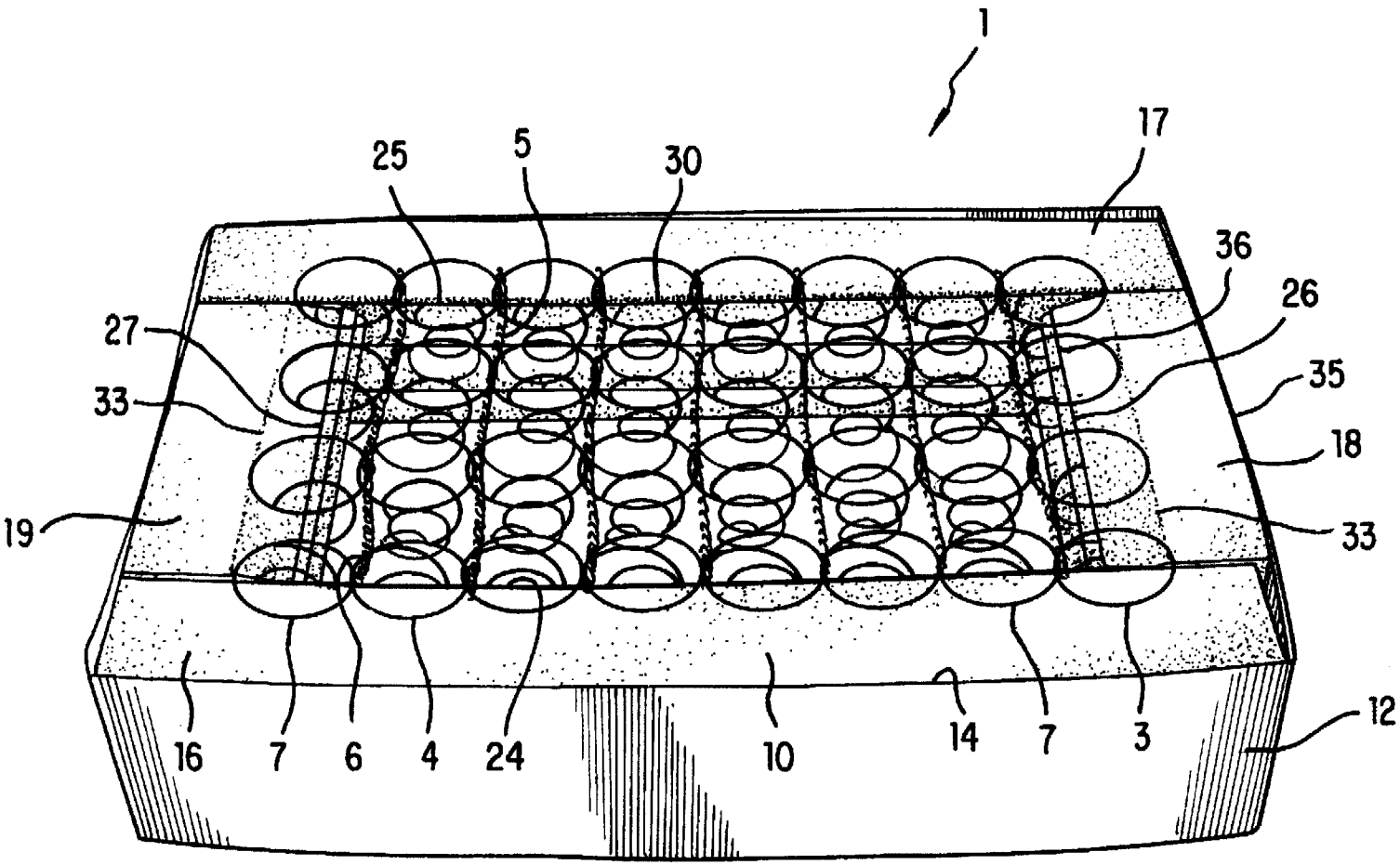
FIG. 1 is a perspective view of an improved cushion or mattress border support.

Referring to the drawings, a typical embodiment of the invention is shown in FIGS. 1–4. Before the present invention is described, however, it is to be understood that this invention is not limited to a particular or specific description. It is also to be understood that the terminology used herein is for the purpose of describing particular embodiments only, and is not intended to be limiting, as the scope of the present invention will be limited only by the appended claims. Further, unless defined otherwise, all terms used herein have the same meaning as commonly understood by one of ordinary skill in the art to which this invention belongs.

Figure 2:
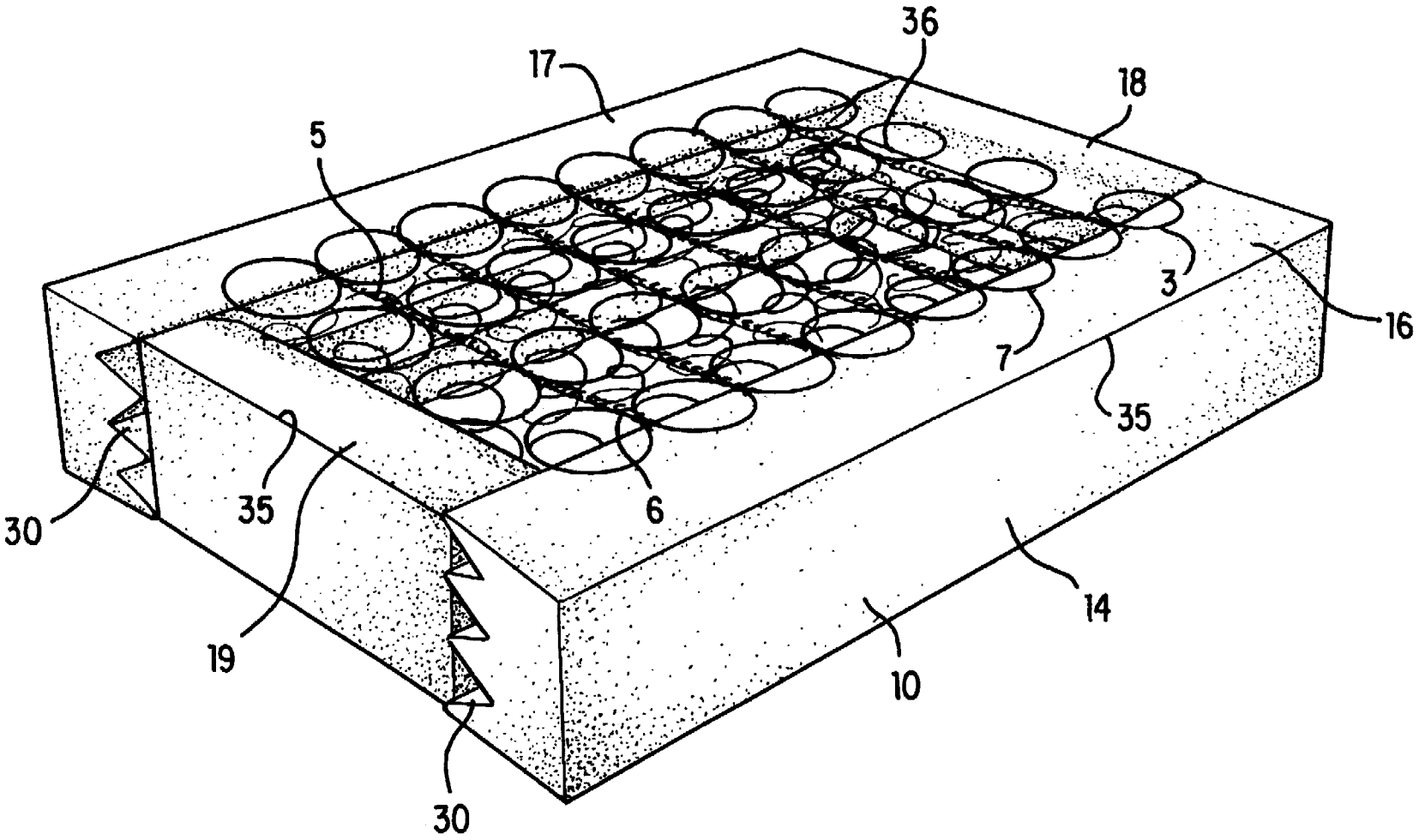
FIG. 2 is a perspective view of one of the improved cushion or mattress border support shown in FIG. 1 without the exterior support band.

Referring now to FIGS. 1 and 2, a mattress or cushion construction 1 is shown having a coil spring unit 3 that is located within a border support 10. The spring coil unit 3 consists of several rows of spring coils 4 held together through the use of helical wires 5. The helical wires 5 are attached to the inside rows 6 of the spring coils 4 such that the helical wires 5 are not used by themselves or with rods to form an outer edge perimeter support or frame for the coil spring unit 3, nor are the helical wires 5 used to connect the outer rows 7 of the spring coils 4 of the coil spring unit 3.

Figure 3:
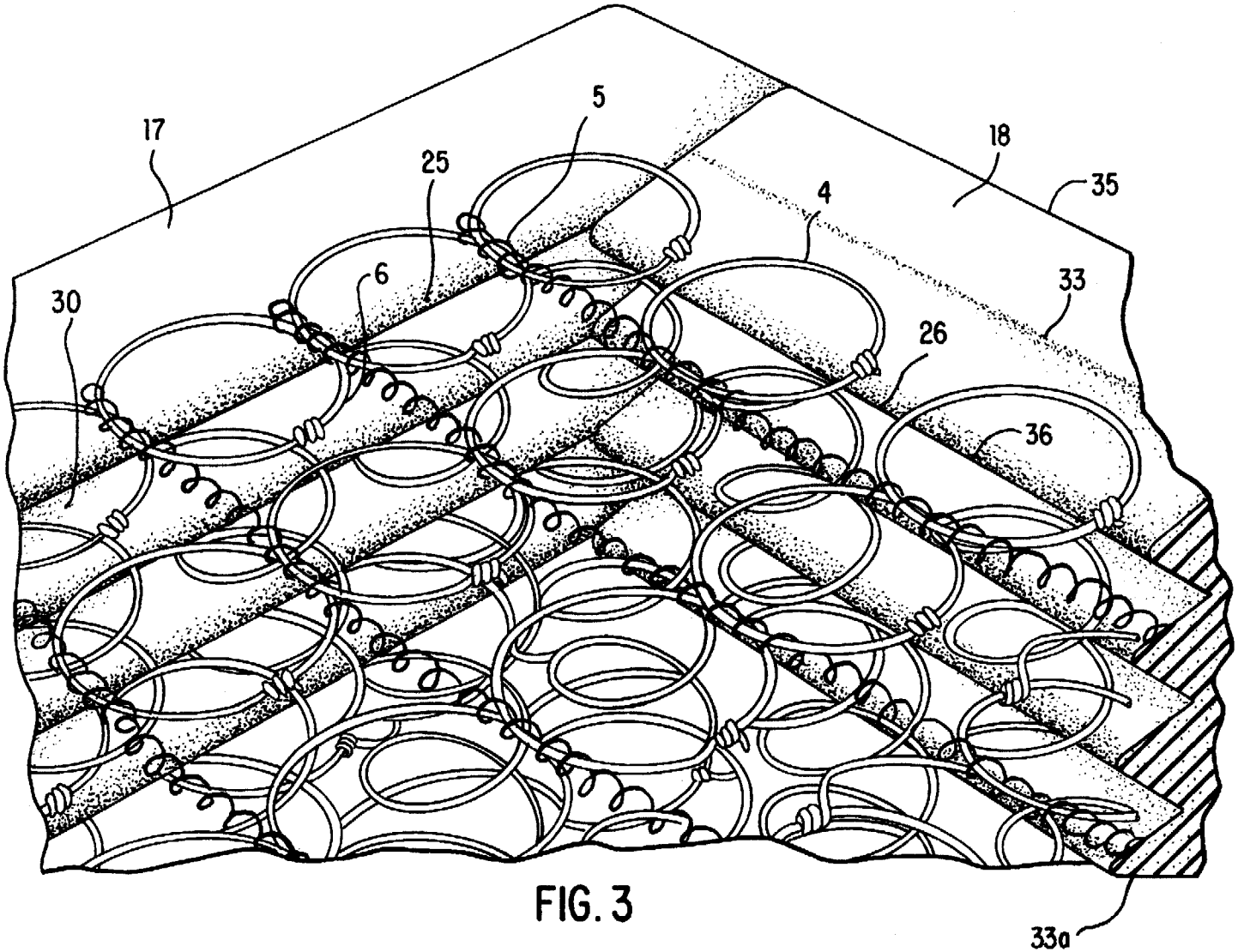
FIG. 3 is a perspective view of the top right corner of the improved cushion or mattress border support shown in FIG. 3.
Figure 4:
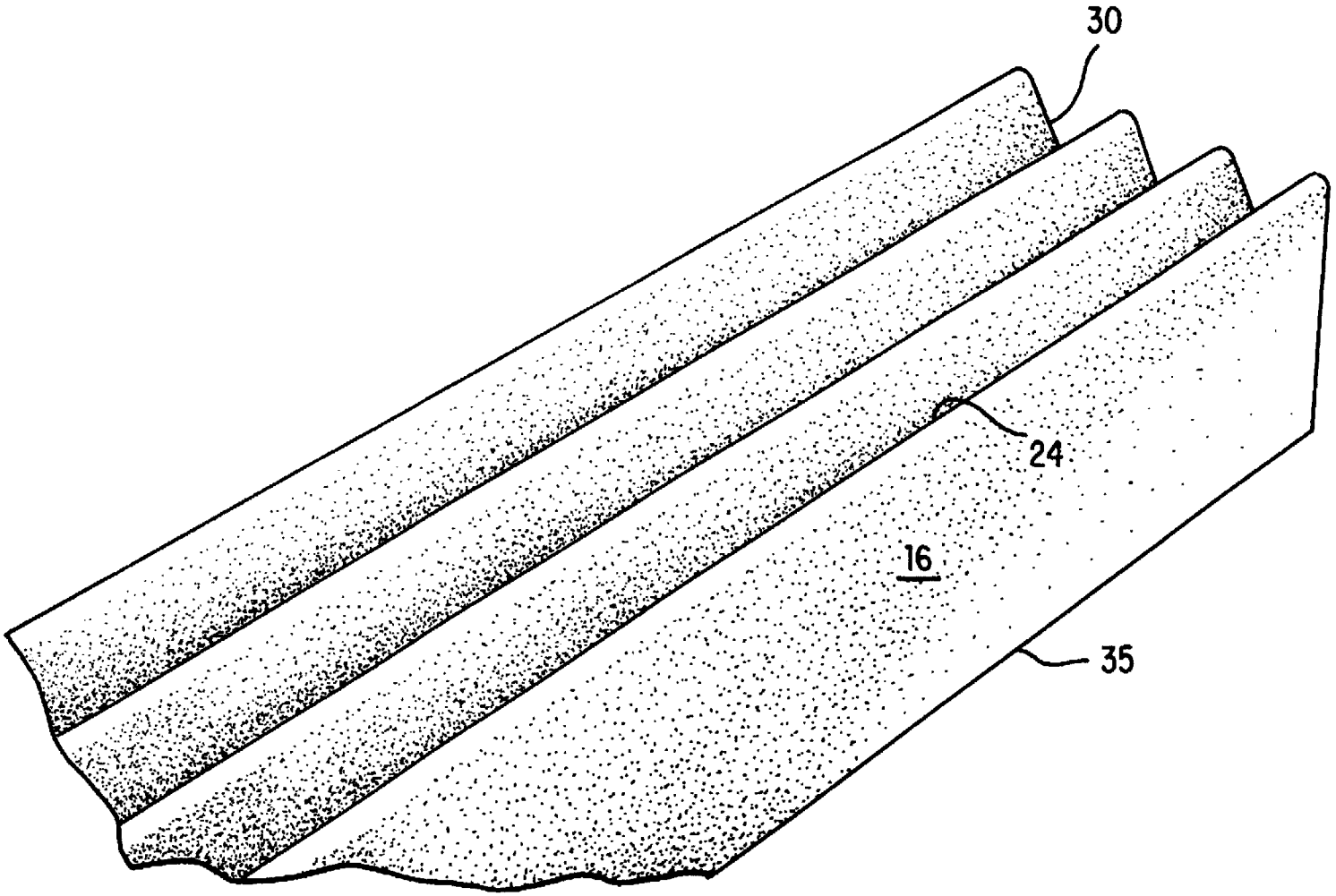
FIG. 4 is a perspective view of one of the sections of the improved cushion or mattress border support shown in FIG. 1.

The border support 10 has a support band 12 that surrounds the outer wall 14 of the border support 10. The border support 10 consists of four resilient polyurethane foam or silicone foam strips 16–19 that surround the periphery of the spring coil unit 3, such that the foam strips 16–19 are placed against the outer rows 7 of the spring coils 4. The foam strips 16–19 can be obtained from foam manufacturers, such as the E.R. Carpenter Company. As shown in FIGS. 2–4, the foam strips 16 and 17 are spaced apart from each other by a distance equal to the length of the foam strips 18 and 19. The foam strips 18 and 19 are spaced apart from each other by a distance approximately equal to the length of the coil spring unit 3. The foam strips 16, 17, 18 and 19 have inside walls 24, 25, 26 and 27, respectively, that are placed against the outer rows 7 of the spring coils 4. The inside walls 24 and 25 have three v-shaped longitudinal grooves 30 that are formed in the surface of the inside walls 24 and 25. The inside walls 26 and 27 of the foam strips 18 and 19 have two v-shaped longitudinal grooves 31 that are formed in the surface of the inside walls 18 and 19. The grooves 30 and 31 are designed to receive the convolutions of the spring coils 4.

Referring to FIGS. 1, 2 and 3, the foam strips 18 and 19 are shown to have a down sloping wedge 33 on the top and a symmetrical upward sloping wedge **33*a* on the bottom of the foam strips 18 and 19 that start midway from the outer edge 35 of the foam strips 18 and 19 and are formed towards the inside edge 36 of the inside walls 26 and 27. The strips 16 and 17 also have an outer edge 35, but do not have the down sloping wedge 33 or the symmetrical upward sloping wedge 33*a*. The result is that the wedges 33 and 33*a* allow the convolution of the coil springs 4 to enter the grooves 31 while also allowing the ends of the grooves 31 to fit snugly against the ends of the grooves 30 of the foam strips 16 and 17**.

As shown in FIG. 1, the coil spring unit 3 is placed against the foam strips 16, 17, 18 and 19 such that the convolutions of the outer rows 7 of the coil springs 4 enter into the grooves 30 and 31. Additionally, the foam strips 18 and 19 are placed against the foam strips 16 and 17, such that the ends of the grooves 31 fit snugly against the ends of the grooves 30. The foam strips 16, 17, 18 and 19 thereby form a perimeter support around the coil spring unit 3. Placed around the outer wall 14 is a support band 12 that keeps the foam strips 16, 17, 18 and 19 in place about the coil spring unit 3. The support band 12 can be made of a fabric sewn together, or can consist of an elastic material. The strips 16, 17, 18 and 19 provide support to the coil springs 4 and form a protective perimeter for the coil spring unit 3. The mattress or cushion construction 1 thereby provides for a strong support for the coil spring unit 3 while eliminating the need for a helicalled or clipped border rod that surrounds the perimeter of the coil spring unit 1.

The mattress or cushion construction I further provides an extended cushioned and supported sleeping or sitting surface from the junction of the coil spring unit 3 with the strips 16, 17, 18 and 19 to the outer edge 35 of the strips 16, 17, 18 and 19. The extended cushioned and supported sleeping or sitting surface provides for a smooth sleeping or sitting surface without the interference or protrusion of a helicalled or clipped border rod.

It is to be understood that while certain forms of this invention have been illustrated and described, the invention is not limited thereto, except insofar as such limitations are included in the following claims.

What is claimed and described to be secured by Letters Patent is as follows:

1. A border support for a mattress or the like comprising:

(a) a coil spring unit having at least one row of coil springs;

(b) at least one foam strip positioned along at least a portion of an outer side of an outermost row of said coil springs; and (c) a support band positioned about the outermost wall of said foam strip;

wherein said foam strip has at least one longitudinal groove formed on the inside wall of said foam strip, and said portions of said outer side of said outermost coil springs extend inwardly into said groove for a distance such that the outer edge of said groove is approximately aligned with the vertical center line of said outermost coil springs, and said foam strip has a down sloping indentation on the top of said foam strip starting at approximately midway the distance from the outermost wall of said foam strip to said inside wall and extends to the edge of said inside wall, said outermost coil springs have top convolutions that extend over said down sloping indentation.

2. The border support as set forth in claim 1, wherein said groove is v-shaped.

3. The border support as set forth in claim 1, wherein said foam strip has an upward sloping indentation on the bottom of said foam strip starting at approximately midway the distance from the outermost wall of said foam strip to said inside wall and extending to the edge of said inside wall, said outermost coil springs having bottom convolutions that extend over said bottom upward sloping indentation.

4. The border support as set forth in claim 1, wherein said border support has a first and second pair of spaced apart parallel foam strips positioned about said coil spring unit.

5. The border support as set forth in claim 1, wherein said first and second pair of spaced apart parallel foam strips each have at least two longitudinal grooves formed on said inside wall of said foam strips that extend between the top and bottom convolutions of said outermost coil springs.

6. A border support for a mattress or the like comprising:

a) a coil spring unit having at least one row of coil springs;

b) a first and second pair of spaced apart parallel foam strips positioned along at least a portion of an outer side of an outermost row of said coil springs; and c) a support band positioned about the outermost wall of said foam strip;

wherein said foam strips each have at least two longitudinal grooves formed on the inside wall of said foam stride, and portions of said outer side of said outermost coil springs extend inwardly into said grooves for a distance such that the outer edge of each of said grooves is approximately aligned with the vertical center line of said outermost coil springs, and wherein said second pair of spaced apart parallel foam strips each has a down sloping indentation on the top of said foam strip starting at approximately midway the distance from the outermost wall of said foam strip to said inside wall and extending to the edge of said inside wall said outermost coil springs having top convolutions that extend over said down sloping indentation.

7. The border support as set forth in claim 6, wherein said grooves are v-shaped.

8. The border support as set forth in claim 6, wherein each of said second pair of spaced apart parallel foam strips has an upward sloping indentation on the bottom of said foam strip starting at approximately midway the distance form the outermost wall of said foam strip to said inside wall and extending to the edge of said inside wall, said outermost coil springs having bottom convolutions that extend over said bottom upward sloping indentations.

9. The border support as set forth in claim 6, wherein said border support has an extended cushioned and supported surface that is formed from the junction of said coil spring unit with said foam strips to said outermost wall of said foam strips, said extended cushioned and supported surface not having a hellcalled or clipped border rod.

* * * * *

UNITED STATES PATENT AND TRADEMARK OFFICE

CERTIFICATE OF CORRECTION

PATENT NO. : 5,724,686

DATED : March 10, 1998

INVENTOR(S) : Charles H. Neal

It is certified that error appears in the above-identified patent and that said Letters Patent is hereby corrected as shown below:

In Claim 6, Line 61, after "foam", please delete -stride- and insert --strips--.
In Claim 8, Line 12, after "the distance", please delete -form- and insert --from--.

Signed and Sealed this

Twenty-eighth Day of July, 1998

*Attest:*

Bruce Lehman

BRUCE LEHMAN

*Attesting Officer*

*Commissioner of Patents and Trademarks*